US006334769B1

(12) United States Patent
Retallick et al.

(10) Patent No.: US 6,334,769 B1
(45) Date of Patent: Jan. 1, 2002

(54) CATALYTIC COMBUSTOR AND METHOD OF OPERATING SAME

(75) Inventors: William B. Retallick, West Chester, PA (US); Brian A. Knight, Tolland, CT (US); Joseph J. Sangiovanni, West Suffield, CT (US); Robert J. Hall, West Hartford, CT (US)

(73) Assignee: United Technologies Corporation, East Hartford, CT (US); a part interest ( * ) Notice: Subject to any disclaimer, the term of this patent is extended or adjusted under 35 U.S.C. 154(b) by 0 days.

(21) Appl. No.: 09/361,774

(22) Filed: Jul. 27, 1999

(51) Int. Cl.[7] ..... F23D 3/40
(52) U.S. Cl. ..... 431/7; 431/170; 431/328
(58) Field of Search ..... 431/7, 170, 328, 431/2, 5, 326; 60/723; 502/339

(56) References Cited

U.S. PATENT DOCUMENTS 4,485,621 A * 12/1984 Wong et al. ..... 60/274
4,870,824 A * 10/1989 Young et al. ..... 431/328
5,202,303 A 4/1993 Retallick et al.
5,232,357 A * 8/1993 Betta et al. ..... 431/7
5,250,489 A 10/1993 Betta et al.
5,326,252 A * 7/1994 Tonon ..... 431/2
5,378,435 A * 1/1995 Gavoni ..... 422/177
5,403,184 A * 4/1995 Hosaka et al. ..... 431/170
5,421,719 A * 6/1995 Saito et al. ..... 431/7
5,512,250 A 4/1996 Betta et al.
5,518,697 A * 5/1996 Betta et al. ..... 431/173
5,577,906 A * 11/1996 Hanakata et al. ..... 431/7
5,786,031 A 7/1998 Retallick et al.
6,174,159 B1 * 1/2001 Smith et al. ..... 431/326

* cited by examiner

*Primary Examiner*—James C. Yeung
(74) *Attorney, Agent, or Firm*—William H. Eilberg

(57) ABSTRACT

A catalytic combustor burns a fuel-air mixture which is not preheated. The combustor includes a strip or strips of metal which define a plurality of alternating wide and narrow channels. The channels contain corrugated strips which maintain the spacing of the channels. A catalyst coating is deposited only in the wider channels, the narrower channels remaining un-catalyzed. The strip or strips can be heated resistively to start the combustion. Once the combustion is started, the electric current is stopped, and the combustion continues. The combustor is useful in a home heating appliance such as a gas furnace. In another embodiment, in which the combustor is used in a high-temperature environment such as in a gas turbine, the catalyst can be deposited in the small channels only, so as to limit the amount of catalytic combustion.

9 Claims, 6 Drawing Sheets

CATALYTIC COMBUSTOR AND METHOD OF OPERATING SAME

BACKGROUND OF THE INVENTION

The present invention relates to the field of catalytic combustion, and provides a catalytic combustor that does not require continuous preheating Catalytic combustors which are built up from metal foil that is coated with catalyst on just one side have been described in the prior art, for example, in U.S. Pat. Nos. 5,202,303, 5,250,489, and 5,512,250, the disclosures of which are hereby incorporated by reference. An object of the catalytic combustion is to minimize the production of nitrogen oxides.

The combustors described in the above-cited patents were intended for gas turbines wherein the turbine compresses the incoming fuel-air mixture, thereby preheating that mixture. The patents show a catalyst coating on only one side of the foil. When the strip of foil is folded back and forth upon itself, the resulting structure comprises a combustor having channels which are catalyzed and channels which contain no catalyst.

Unlike the case of a gas turbine, the fuel-air mixture that enters a catalytic combustor in a home heating appliance such as a gas furnace is not preheated. If the catalyzed channels and the bare channels of the catalytic combustor are of the same size, there is so much cooling that the catalyzed surface cannot be kept hot enough to support combustion. The latter statement is true because of heat transfer from the catalyzed channels to the non-catalyzed channels. This heat transfer effectively cools the catalyzed channels below the temperature at which they will sustain combustion. The latter effect is observed even if the entering fuel mixture is preheated enough to ignite the combustion. When the preheating is stopped, the combustor cools and combustion stops.

The present invention solves the above-described problem by providing a catalytic combustor which can operate without preheat. In particular, an appliance using a combustor made according to the present invention can be heated electrically to start the combustion, after which it will operate with no electric current.

SUMMARY OF THE INVENTION

The catalytic combustor of the present invention maintains combustion without preheat once the combustion has started. The combustor comprises channels which are coated with catalyst, and channels having no catalyst coating. The ratio of the cross-sectional area of the catalyzed channels to the cross-sectional area of the uncatalyzed channels is chosen to be great enough to support combustion without preheat, but low enough to prevent deactivation of the catalyst due to excessive heat of combustion. By making the cross-sectional area of the catalyzed channels larger than that of the uncatalyzed channels, the gas flow through the former will be greater than the flow through the latter, and the temperature of the dividing walls between the channels will be maintained at a temperature high enough to support catalytic combustion without preheat.

In one embodiment, the combustor of the present invention comprises a plurality of spaced-apart metal strips, the strips defining alternating wide and narrow channels for gas flow. Only the sides of the strips facing the wide channels are coated with catalyst.

Another embodiment comprises a plurality of corrugated strips, separated by a plurality of pairs of flat divider strips, and a plurality of structural members located between the pairs of divider strips. The corrugated strips are coated with a combustion catalyst, and the structural members have no catalyst coating. The sides of the divider strips which face the corrugated strips are also coated with catalyst.

In another embodiment, the catalytic combustor comprises a continuous strip of metal which is folded back and forth upon itself, with a plurality of corrugated strips positioned within some of the folds, and a plurality of structural members positioned within other folds, the corrugated strips and structural members alternating with each other. Only the side of the continuous strip which faces the corrugated strips is coated with a combustion catalyst. The continuous strip is connected to a source of electric current, and preferably has an electrically insulating coating.

Another embodiment comprises a stack including a first flat strip, a first corrugated strip, a second flat strip, and a second corrugated strip, the stack being wound into a spiral. The first corrugated strip has corrugations which are larger than the corrugations of the second strip. At least the first corrugated strip is coated with a catalyst. At least one of the flat strips is connected to a source of electric current. The flat strips preferably also have an electrically insulating coating.

In another embodiment, the catalytic combustor comprises a continuous corrugated strip, the strip having wide and narrow corrugations which alternate with each other, the corrugated strip being folded back and forth upon itself. A plurality of divider strips separate the folds of the corrugated strip. The corrugated strip is coated with catalyst on the side which defines the wide corrugations, and is connected to a source of electric current. The divider strips preferably have an electrically insulating coating. The flat strips may also be coated with catalyst on the sides which face the wide corrugations.

In another embodiment, the catalytic combustor comprises first and second continuous strips which are wound together to form a spiral. The first strip has alternating wide and narrow corrugations, and the second strip is substantially flat. The first strip is coated with a catalyst on the side which faces the wide corrugations. The second strip is also coated with catalyst on the side which faces the wide corrugations. At least one of the strips is connected to a source of electric current, and at least one of the strips has an electrically insulating barrier.

In another embodiment, a plurality of strips are arranged to define alternating wide and narrow channels. The sides of the strips that face the wider channels are coated with catalyst, and the other sides are not coated. The strips are positioned such that the size of the channels tapers down in the direction of gas flow. This embodiment can be constructed using a single strip which is folded back and forth upon itself to define the various channels.

The invention also comprises a method of operating a catalytic combustor. The method includes the step of selecting a ratio of the cross-sectional area of catalyzed channels, to the cross-sectional area of the uncatalyzed channels, such that the ratio is large enough to sustain catalytic combustion, and small enough to prevent deactivation of the catalyst due to excessive heat of combustion. Then, a combustion gas is passed through the combustor, without any preheat. The method may also include the step of igniting the combustion gas by non-catalytic means, such as by electric heating, and halting the ignition step when the combustion gas has ignited. If the above-mentioned ratio is properly chosen, the combustor will operate continuously without preheat.

The present invention therefore has a principal object of providing a catalytic combustor which, once ignited, requires no preheat.

The invention has the further object of providing a method of operating a catalytic combustor, which method does not require preheat.

The invention has the further object of providing a catalytic combustor which can be ignited by resistive heating.

The invention has the further object of providing a method of catalytic combustion in which the combustion can be started by resistive heating.

The invention has the further object of providing a catalytic combustor which is compact, so that it can be used in home heating appliances.

The invention has the further object of providing a catalytic combustor for use in a gas turbine.

The reader skilled in the art will recognize other objects and advantages of the present invention, from a reading of the following brief description of the drawings, the detailed description of the invention, and the appended claims.

DETAILED DESCRIPTION OF THE INVENTION

The present invention includes a catalytic combustor, and a method of operating a catalytic combustor, wherein the combustor can operate continuously without preheat after combustion has been started. The combustor includes channels which are coated with catalyst, and channels having no catalyst. The cross-sectional area, as "seen" by the incoming fuel-air mixture, of the catalyzed channels is greater than that of the uncatalyzed channels. Thus, the gas flow through the catalyzed channels is greater than the flow through the uncatalyzed channels. The gas flow through the catalyzed channels is sufficiently higher than the flow through the uncatalyzed channels that the temperature in the combustor is high enough to support catalytic combustion. The combustor operates in thermal balance, without preheat. On the other hand, the gas flow through the catalyzed channels is not so high that it destroys the activity of the catalyst.

The catalyzed channels are preferably arranged in rows which alternate with rows of uncatalyzed channels. There may be a dividing wall between the rows of channels. If the cross-sectional areas of the catalyzed and uncatalyzed channels are properly chosen, the heat from the catalyzed channels will maintain the dividing wall at a temperature high enough to support catalytic combustion.

Figure 1:
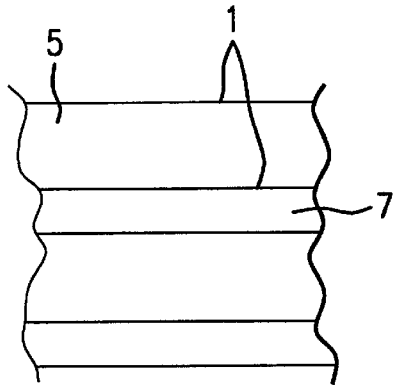
FIG. 1 provides a cross-sectional view, taken in the direction "seen" by incoming combustion gas, of a combustor made according to the present invention, wherein the combustor comprises only a plurality of flat strips of metal foil.

FIGS. 1–6 provide views of various embodiments of a combustor as "seen" by the gas flowing through it. FIG. 1 shows the simplest form of the combustor. The combustor of FIG. 1 comprises a plurality of flat strips 1 which are supported only by the side walls of the combustor. The strips are arranged so that they form channels of varying width. In particular, wide channels 5 alternate with narrow channels 7. There is a combustion catalyst on the surfaces of the strips which face the wider channels. The catalyst is not shown explicitly in the drawings.

The strips forming the combustor of FIG. 1 together form rows of channels which are coated with catalyst. Between the rows of catalyzed channels are channels which contain no catalyst. The total cross-sectional area of the catalyzed channels is clearly greater than the total cross-sectional area of the uncatalyzed channels. Thus, for any given rate of gas flow through the combustor (which flow is directed perpendicular to the paper, in all of the figures), more gas will flow through the catalyzed channels than through the uncatalyzed channels.

Figure 2:
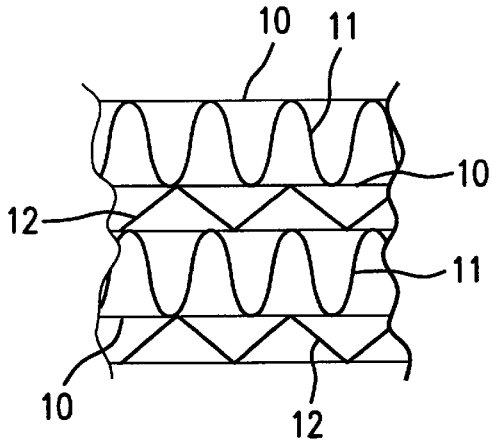
FIG. 2 provides a view, similar to that of FIG. 1, of another combustor made according to the present invention, wherein catalyzed and uncatalyzed channels are separated by flat strips which comprise dividing walls.

FIG. 2 shows another embodiment of the combustor of the present invention. FIG. 2 shows pairs of flat divider strips 10, corrugated strips 11 which are coated with a combustion catalyst, and structural members 12, located between the pairs of divider strips, the structural members having no catalyst coating. The sides of flat strips 10 which face the corrugated strips 11 are coated with catalyst. This combustor works in the same way as that of FIG. 1.

Figure 3:
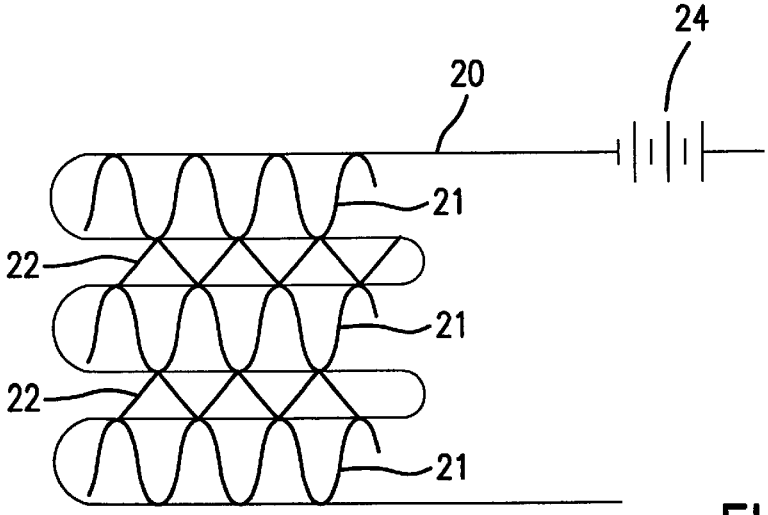
FIG. 3 provides a cross-sectional view of another embodiment of the invention, wherein the dividing walls have been joined into a continuous strip which can be heated resistively.

FIG. 3 shows another embodiment of the combustor in which the flat divider strips are replaced by a single continuous strip 20 which can be heated resistively. The combustor is ignited by passing a current through the continuous strip. The source of electric current is symbolically indicated by battery 24. Once combustion is started, the current is stopped, and the combustion continues, without any preheat. The strip 20 could be initially formed in one piece and folded back and forth upon itself to assume the configuration shown in FIG. 3, or it could be formed by joining the separate divider strips of FIG. 2 to form a continuous strip. Both sides of strip 20 are coated with an electrical insulator (not shown in the drawings). One side of strip 20 faces the corrugated strips 21, and the other side faces structural members 22. The side of strip 20 that faces corrugated strips 21 is coated with catalyst. The other side of the strip 20 is not so coated. The combustor in the Example, described below, has a construction similar to that of FIG. 3.

Figure 4:
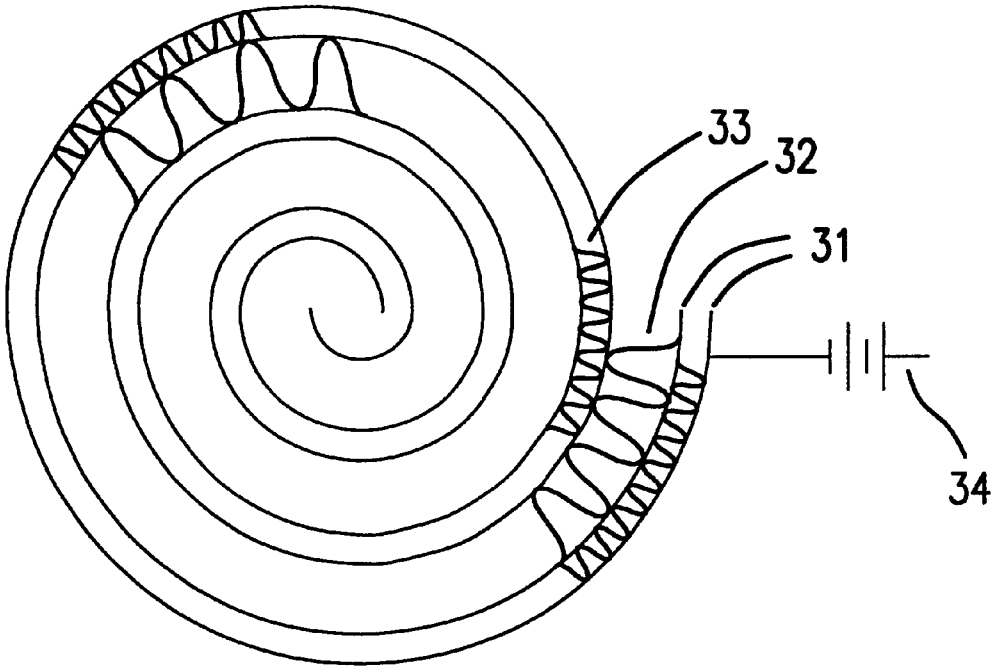
FIG. 4 provides a cross-sectional view of another embodiment of the invention, wherein the strips have been wound into a spiral.

FIG. 4 shows an embodiment of the present invention wherein a repeating stack of flat strips 31, corrugated strips 32, flat strips 31, and structural supports 33 has been wound into a spiral. The flat strips could be heated electrically; the source of electric current is indicated symbolically by battery 34. The flat strips preferably have an electrically insulating coating.

Figure 5:
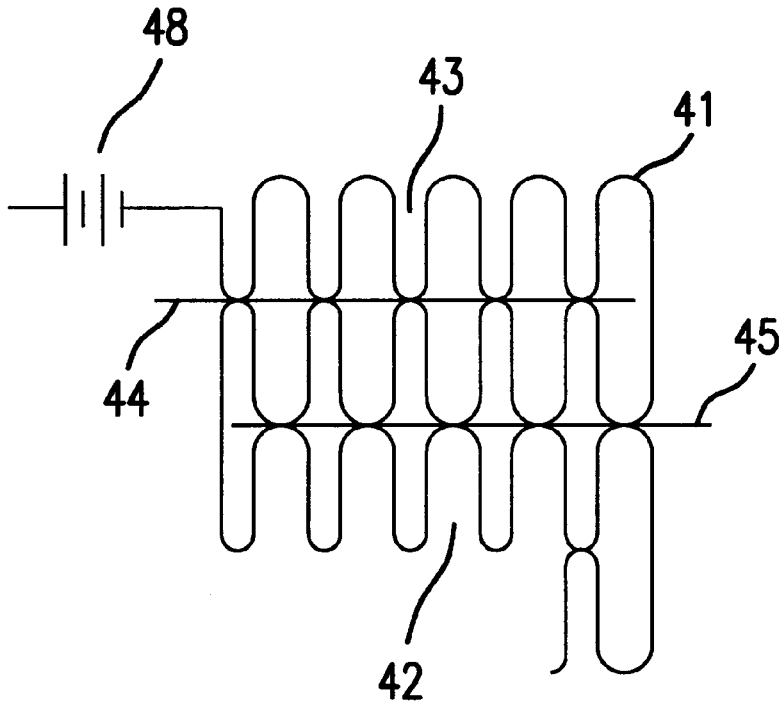
FIG. 5 provides a cross-sectional view of another embodiment of the invention, wherein the heater strip is corrugated to form alternating wider and narrower channels.

FIG. 5 shows an embodiment wherein a heater strip 41 is corrugated to form alternating wider channels 42 and narrower channels 43. As shown in FIG. 5, strip 41 is a single corrugated strip folded back and forth upon itself. Strip 41 is coated with catalyst on the side which faces and defines the wider channels. Divider strips 44 and 45 are coated with an electrically insulating barrier on both sides. Strip 44 can also be coated with catalyst on both sides. Strip 45 has no catalyst coating. The combustor comprises a repeating pattern of folds, with strips 44 alternating with strips 45. An advantage of this embodiment is that most or all of the catalyzed surface is on the heater strip. This arrangement gives a faster light-off than the embodiment of FIG. 3. This embodiment is intended to give the same performance as the combustor in the Example, below, where the width of the strips was 0.8 inch. Thus, the preferred width of the heater strip in FIG. 5 is one inch or less. The source of electric current is symbolically indicated by battery 48.

Figure 6:
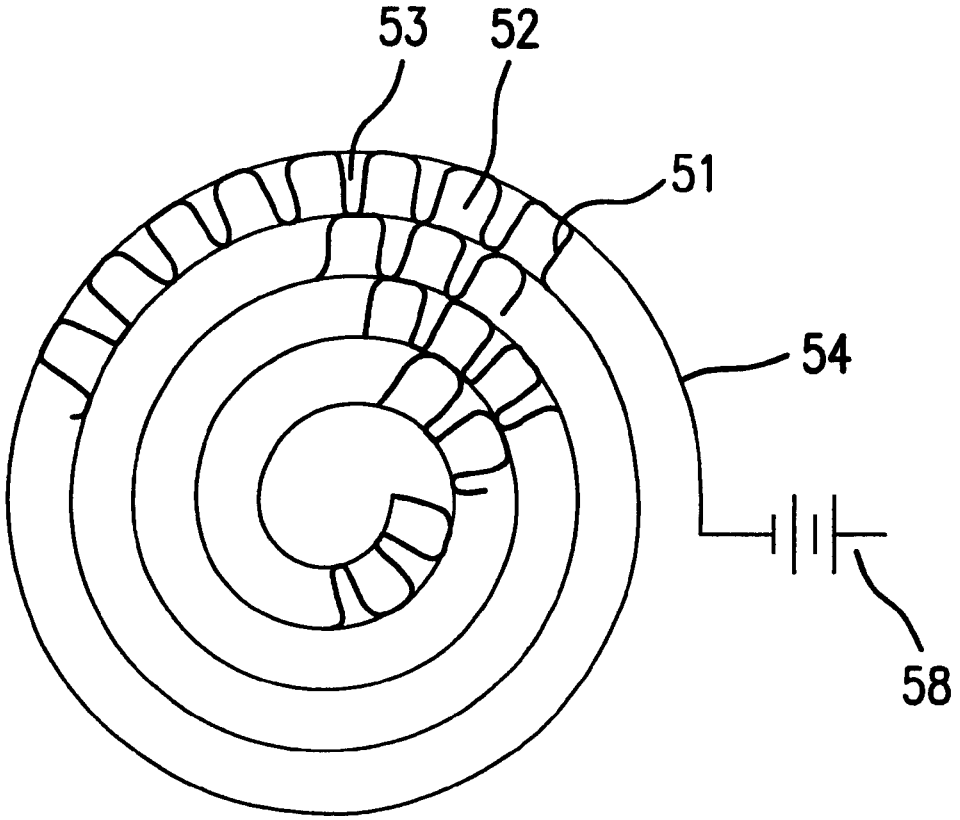
FIG. 6 provides a cross-sectional view of another embodiment of the invention, in which the corrugated strip of FIG. 5 has been wound into a spiral.

FIG. 6 shows an embodiment wherein the combustor comprises two strips which are wound together to form a spiral. One strip 51 is corrugated to form wider channels 52 alternating with narrower channels 53. Strip 51 is coated with catalyst only on the side which faces the wider channels. The flat strip 54 is the divider strip. Strip 54 is coated with an electrically insulating barrier on both sides. Such a barrier may be made according to the teachings of U.S. patent application Ser. No. 08/477,981, the disclosure of which is incorporated by reference herein, or by other means. Strip 54 can also be coated with catalyst on the side which faces the wider channels of strip 51. Either or both strips can be heated resistively. A source of electric current is indicated symbolically by battery 58. It is convenient to join both strips at the center of the spiral and pass the same current through both strips. The electrically insulating barrier can also be used with other embodiments, such as that of FIG. 3. In the latter case, the heater strip is coated with catalyst only on the side that faces the larger corrugations.

Figure 7:
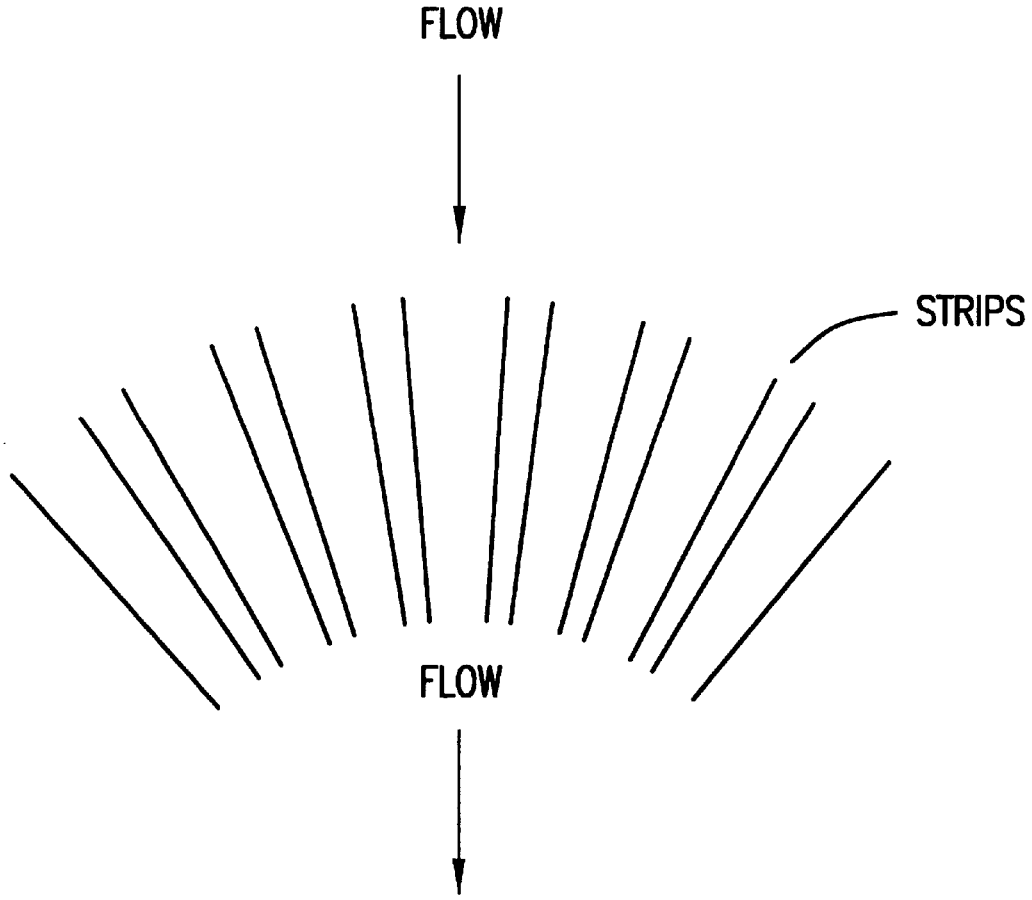
FIG. 7 provides a cross-sectional view of another embodiment in which the channels taper down in the direction of gas flow.

FIG. 7 shows an embodiment wherein the channels taper down in the direction of gas flow. The gas flow is indicated by the arrows. FIG. 7 provides a cross-section through the combustor, which can comprise a plurality of individual strips or a single strip folded back and forth upon itself. In the latter case, the axes of folding would be parallel to the plane of the paper, so that the gas flowing in the direction indicated by the arrows would be able to flow through the combustor. Whether the channels are formed of individual strips or from a single folded strip, the strip or strips are held in position by a suitable holding means (not shown) as will be apparent to persons skilled in the art. As in the previous embodiments, wider channels alternate with narrower channels. Only the side of a strip which faces a wider channel is coated with catalyst. The tapered channels cause the velocity to increase in the direction of gas flow. This increase in velocity is intended to prevent the flame combustion that exists at the outlet from propagating back into the combustor.

The embodiment of the present invention wherein the catalyst is deposited only in the large channels works because the volume of gas flow is less through the smaller channels than in the larger channels. Thus, in contrast to the case where all the channels are of equal size, less heat is carried away by the gas flowing in the uncatalyzed channels, so the temperature in the large, catalyzed channels is not allowed to fall below that needed to maintain combustion.

The combustor of the present invention does have application in a gas turbine, where the fuel-air mixture is preheated by compression. In a gas turbine, it may not be necessary to heat the strip electrically. Also, given a sufficiently high preheat temperature, or a sufficiently high fuel-air ratio, it may be advantageous to put the catalyst on the sides of the flat strips that face the smaller corrugations. The reason is that in the gas turbine, unlike the home heating appliance, the problem tends to be too much combustion, not too little. Excessive catalytic combustion could destroy the combustor entirely. By placing the catalyst in the narrow channels, one reduces the fraction of the fuel that is combusted, since there is less fuel flowing through those channels. Also, since the wide channels have greater gas flow, and no catalyst, the gas flowing through the wide channels carries away more of the heat generated in the narrow channels. Thus, the combustor of the above-described embodiment inherently limits the heat generated by the combustion.

From the above description, one can see that the present invention provides a means of passively controlling the amount of combustion in a catalytic combustor. By varying the size of the channels, and by choosing the channels in which to deposit the combustion catalyst, one can address the problem of too much or too little combustion, according to the application in which the combustor will be used.

EXAMPLE

Figure 8:
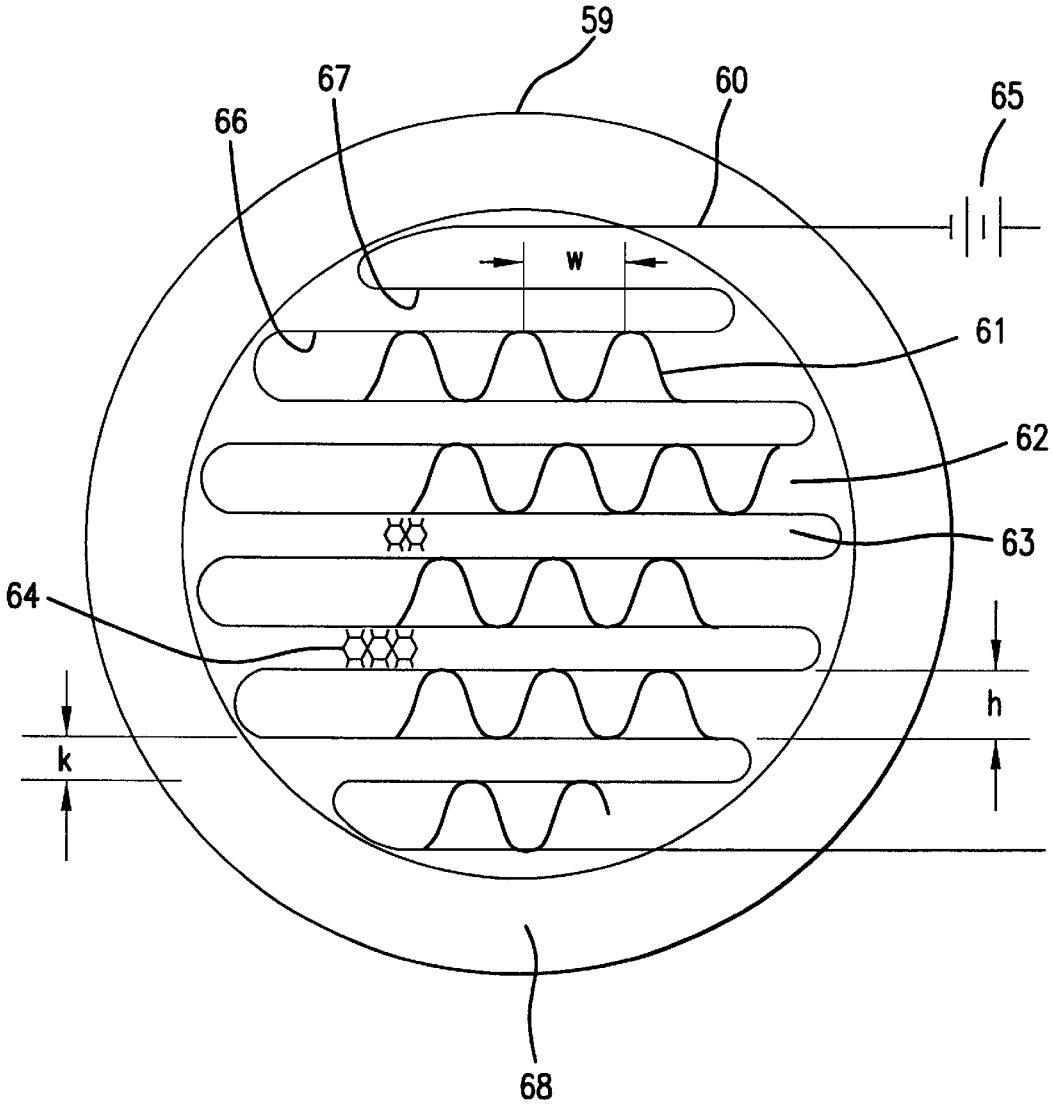
FIG. 8 is a simplified end view, in the direction of combustion gas flow, depicting a catalytic combustor made according to the present invention, and which was successfully tested.

An experimental catalytic combustor 59, of circular cross-section in the flow direction, was constructed according to the configuration shown in FIG. 8, which is most similar to the previously described configuration of FIG. 3. The combustor 59 comprised a continuous, serpentine heater strip 60, a plurality of corrugated strips 61, a plurality of steel honeycomb structural supports 64, and a solid support ring 68. The heater strip 60, connected to a battery 65, formed a plurality of alternately wide and narrow flow channels 62, 63, respectively. The heater strip 60 was coated with platinum catalyst on the side 66 facing the wide channel 62, and was uncatalyzed on its other side 67 facing the narrow channels 63. Disposed within and extending completely across each wide channel 62 was a corrugated strip 61 coated with platinum catalyst on both sides. Disposed within each narrow channel 63 was an uncatalyzed honeycomb structural support 64. (In the drawing, only portions of the corrugated strips 61 and portions of the honeycomb supports are shown, for simplicity of illustration.) The combustor was thus comprised of a plurality of alternately catalyzed flow channels 62 and uncatalyzed flow channels 63.

The ring 68 surrounded and supported the strips and formed a 2.0 inch diameter outer wall of the flow path. The width of the heater strips and corrugated strips 60, 61 (perpendicular to the page of the drawing) was 0.8 inch, which was the length of the flow path of the fuel-air mixture. The height h of the catalyzed channels 62, which was also the height of the corrugated strips 61, was 0.15 inch. The height k of the uncatalyzed channnels, which was also the height of the honeycomb supports 64, was 0.075 inch. The wavelength w of the corrugated strips was 0.14 inch. Thus, in this successful experimental catalytic combustor, the ratio of flow through catalyzed channels 62 to flow through uncatalyzed channels 63 was two to one.

The fuel was methane, with 60% excess air. It is significant that the excess air can be as low as 60%. The adiabatic combustion temperature with 60% excess air, and no preheat, is 1400° C. If all of the feed gas were combusted on the catalytic surface, the catalyst would deactivate quickly. In the present combustor, the combustion is completed in the flame which follows the catalytic combustor, and the combustor survives. The methane feed rate was equivalent to 20,000 BTU per hour. An electric current was applied to the strip to start the combustion.

After combustion had started and the electric current had been turned off, the following measurements were made:

1) The temperature at the outlet of the catalyzed channels was 950° C. This measurement was obtained by placing a probe into one of the catalyzed channels, or by placing it so close that the only temperature it could measure is that of the selected catalyzed channel.

2) The temperature at the inlet to the combustor was 65° C.

3) The conversion of methane in the catalyzed subsection was 100%.

4) The amount of $NO_x$ in the output stream was 0.1–0.5 ppm.

5) The amount of CO in the output stream was greater than 500 ppm.

The objective of low $NO_x$ was accomplished. The 500 ppm of CO would be burned up in the flame which follows the catalytic combustor. It is believed that the temperature measured at the inlet (65° C.) was greater than room temperature because of radiation from the inlet face of the combustor.

The combustor can be formed in other shapes, within the scope of the present invention. One example is to arrange the strips in the shape of an "S". In all of the above-described alternatives, the channels have alternating or varying widths. The source of electric current need not be a battery; the electric current can be provided and controlled by other means. These and other alternatives should be deemed within the spirit and scope of the following claims.

What is claimed is:

1. A method of operating a catalytic combustor having a plurality of catalyzed channels and a plurality of uncatalyzed channels, the method comprising the steps of:

a) selecting a cross-sectional area of the catalyzed channels and a cross-sectional area of the uncatalyzed channels, such that a ratio of the cross-sectional area of the catalyzed channels to the cross-sectional area of the uncatalyzed channels is large enough to support continuous catalytic combustion without preheat and small enough to prevent deactivation of catalyst by excessive heat of combustion, and b) passing a combustion gas through the entire combustor having said ratio, without continuous preheating of the combustion gas.

2. The method of claim 1, wherein step (b) is performed simultaneously with the step of igniting the combustion gas non-catalytically.

3. The method of claim 2, wherein the igniting step comprises the step of passing an electric current through the combustor.

4. The method of claim 2, wherein the igniting step is halted after combustion begins, and wherein the combustor continues to operate by catalytic combustion alone.

5. The method of claim 1, wherein the temperature of the combustion gas is not greater than about 65° C.

6. A catalytic combustor comprising first and second continuous strips which are wound together to form a spiral, the first strip having alternating wide and narrow corrugations which define alternating wide and narrow channels, the second strip being uncorrugated, the first strip being coated with a combustion catalyst only on a side which faces the wide channels, wherein the wide channels have a cross-sectional area, and wherein the narrow channels have a cross-sectional area, and wherein the cross-sectional areas of the wide and narrow channels are chosen such that a ratio of the cross-sectional area of the wide channels to the cross-sectional area of the narrow channels is large enough to support continuous catalytic combustion without continuous preheat and small enough to prevent deactivation of the catalyst by excessive heat of combustion.

7. The catalytic combustor of claim 6, wherein the second strip is coated with a combustion catalyst on a side which faces the wide channels.

8. The catalytic combustor of claim 6, wherein at least one of the strips is connected to a source of electric current.

9. The catalytic combustor of claim 6, wherein at least one of the strips has an electrically insulating coating.

* * * * *